United States Patent [19]

Aimoto et al.

[11] Patent Number: 4,974,023

[45] Date of Patent: Nov. 27, 1990

[54] DEVELOPING DEVICE FOR COPIER

[75] Inventors: Toyoka Aimoto; Kazuhiro Satou; Takashi Miyaji, all of Nara, Japan

[73] Assignee: Sharp Kabushiki Kaisha, Osaka, Japan

[21] Appl. No.: 210,224

[22] Filed: Jun. 23, 1988

[51] Int. Cl.[5] ..... G03G 15/06; G03G 21/00

[52] U.S. Cl. ..... 355/245; 355/210; 355/260

[58] Field of Search ..... 355/200, 210, 245, 260; 222/DIG. 1

[56] References Cited

U.S. PATENT DOCUMENTS

| | | | |
|---|---|---|---|
| 3,947,107 | 3/1976 | Smith | 355/260 X |
| 4,089,601 | 5/1978 | Navone | 355/260 X |
| 4,306,804 | 12/1981 | Sakamoto et al. | 355/210 |
| 4,339,196 | 7/1982 | Beck et al. | 355/245 X |
| 4,478,512 | 10/1984 | Zoltner | 355/260 |
| 4,491,161 | 1/1985 | Tamura et al. | 355/260 X |
| 4,516,849 | 5/1985 | Tsutsui et al. | 355/298 X |
| 4,523,834 | 6/1985 | Pelda et al. | 355/260 |
| 4,607,939 | 8/1986 | Saito | 355/245 X |
| 4,615,605 | 10/1986 | Kida et al. | 355/200 |
| 4,619,516 | 10/1986 | Iwai | 355/245 |
| 4,650,097 | 3/1987 | Hagihara et al. | 355/245 X |

FOREIGN PATENT DOCUMENTS

| | | | |
|---|---|---|---|
| 61-156174 | 7/1986 | Japan | 355/260 |
| 61-221770 | 10/1986 | Japan | 355/260 |

*Primary Examiner*—Fred L. Braun

*Attorney, Agent, or Firm*—Flehr, Hohbach, Test, Albritton & Herbert

[57] ABSTRACT

A developing device of an electrophotographic copier is structured separably into two mutually attachable and internally connected sections. One of these sections is disposed adjacent to the copier's photoreceptor and contains a developing roller and the other section distal from the photoreceptor is made of a relatively inexpensive synthetic resin material, including a stirrer roller. When the developing agent is spent, the two sections are separated and only the second part with the stirring roller is discarded for replacement. In order that the spent developing agent can be effectively collected, a bar magnet may be inserted into a chamber formed inside the shaft of the stirrer roller to make use of its magnetic force or a scrapper may be provided to scrape off the developing agent remaining attached to the developing roller. In the case of a clam shell type copier with a top part of the main body made openable rotatingly with respect to its base part, the developing device becomes tilted when the copier is opened for its replacement. A device for shaking the tank can effectively cause the developing agent remaining inside to move into the lower section of the device for easy collection.

14 Claims, 13 Drawing Sheets

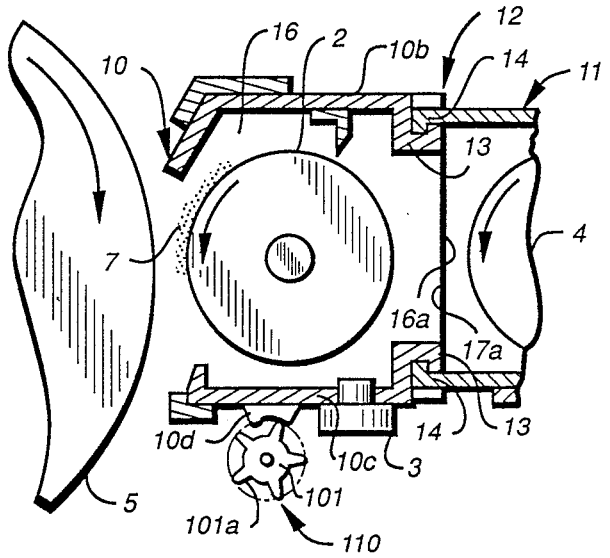
FIG._25
FIG._35
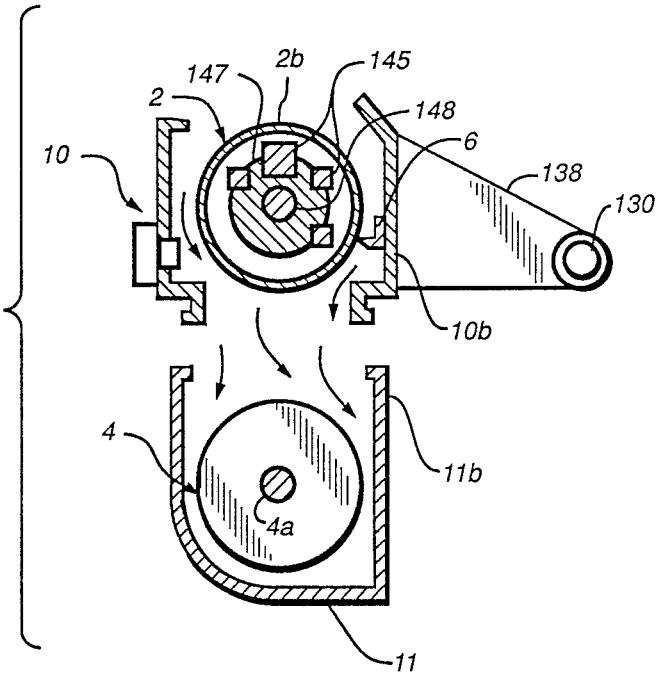

DEVELOPING DEVICE FOR COPIER

BACKGROUND OF THE INVENTION

This invention relates to a developing device for an electrophotographic copier having a developing tank provided with a developing roller and a toner stirrer roller. The invention also relates in particular to a developing device for a copier of the so-called clam shell type of which the main body can be separated into an openable upper part and a horizontal base part.

An exemplary prior art developing device for a copier is illustrated for the purpose of comparison in FIG. 1 wherein numeral 5 indicates a photoreceptor and a developing tank 1, typically made of a metallic material, is disposed adjacent thereto. A developing roller (or magnet roller) 2 is supported inside the developing tank 1 on the side proximal to the photoreceptor 5 and a sensor for toner concentration 3 is affixed to the bottom plate la of the developing tank 1 below the developing roller 2. A toner stirrer roller 4 is supported inside the tank 1 on the distal side from the photoreceptor 5. The developing tank 1 is filled with a specified amount of developing agent 7 which may comprise only of toner (in the case of a single-component developing agent) or of toner and a carrier (in the case of a two-component developing agent). Numeral 6 indicates a doctor blade for regulating the thickness of the developing agent 7 attached onto the developing roller 2. If the developing agent 7 becomes insufficient or its lifetime has passed, the developing tank 1 which has been in use is discarded and is replaced by a new one. When a developing tank 1 is thus discarded, the developing roller 2, the toner concentration sensor 3 and the toner stirrer roller 4 which are attached to the tank 1 are also discarded at the same time.

Among the components of the developing device supported by or attached to the developing tank 1, the developing roller 2 and the toner concentration sensor 3 are relatively expensive and their lifetimes are longer than the lifetime of the developing agent 7. In other words, it is not economical to throw away these expensive components together with the developing agent 7 which has been spent.

The developing device described above may be disengageably attached to the housing of the copier (or a main frame supporting the housing) directly or, as shown schematically in FIG. 2, attached to and made a part of a much larger developing unit 80 including a case 81 which contains therein not only the aforementioned developing device but also the photoreceptor 5, a cleaning device 86, etc. In FIG. 2 which is a schematic sectional view of a copier of this type, numeral 78 indicates an optical unit, numeral 79 indicates a paper supplying device, numeral 82 indicates a fixing device and numeral 83 indicates a paper transporting device. If the developing agent 7 has been spent in a copier of this type, not only the spent developing agent 7 but also the photoreceptor 5 and the cleaning device 86, which may be still very much usable, are discarded with the case 8.

SUMMARY OF THE INVENTION

It is an object of the present invention in view of the above to provide a developing device of a copier which allows its developing tank to be replaced in an economically advantageous manner.

It is another object of the present invention to provide a developing device of a copier which allows the developing agent left inside to be effectively collected when it is replaced by a new one.

The above and other objects of the present invention are achieved by providing a developing device for an electrophotographic copier characterized as having a developing tank which is not unistructural like prior art developing tanks but is separable into two mutually attachable and internally connected sections. One of the sections, hereinafter referred to as the first developing section for convenience, is disposed adjacent to the photoreceptor for the copier and therefore contains the developing roller. The other section, hereinafter referred to as the second developing section, is disposed distal from the photoreceptor and contains the stirrer roller. With a developing tank thus structured separably, the first developing section, which includes relatively more expensive components, need not be discarded with the developing agent which has been in use and must be replaced. The user has only to disengage the second developing section from the first developing section, remove it from the developing device and discard it for a new one. If the second developing section, together with the stirrer roller contained therein, is made of a synthetic resin material, replacements can be effected more economically and the developing device, as a whole, can be made lighter and easier to disassemble because of lower friction.

Because a developing tank embodying the present invention is separable into first and second developing sections, however, it is desirable to move as much developing agent as possible into the second developing section before the tank is separated. Gravity alone cannot serve this purpose adequately because the developing roller in the first developing section contains magnets to keep toner particles attached to its sleeve (not separately shown in FIG. 1). According to one embodiment of the present invention, the shaft for the stirrer roller is made hollow with a cylindrical chamber therethrough and a bar magnet is inserted thereinto before the first and second developing sections are separated from each other such that the developing agent left inside the tank is attracted by its magnetic force and moves into the second developing section. According to another embodiment of the present invention, a scraper is provided inside the first developing section. This scraper is normally kept away from the developing roller but is brought closer to the sleeve and the sleeve is rotated such that the developing agent attached on the sleeve can be scrapped off.

Of particular interest are developing devices especially adapted for a clam shell type copier with its main body separably structured with a part containing its photoreceptor and developing device rotatably connected to a stationary base part. When the part containing the developing device is lifted up by rotating it around the axis connecting the openable and the base parts of the copier, the developing device becomes tilted with its first developing section positioned slightly higher than the second developing section. According to one embodiment of the present invention, the developing device is rotatably supported by the main body of the copier and is automatically rotated further until it becomes vertically oriented with its first developing section exactly above the second developing section such that the latter can be removed from the former without spilling the developing agent left inside. According to another embodiment of the present invention, a device of various types is attached to the bottom of the first developing section for causing the developing tank to vibrate such that the developing agent is shaken off from the surface of the sleeve and dropped into the second developing section.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 25 is a frontal sectional view of a portion of the developing device shown in FIGS. 23 and 24, FIG. 35 is a frontal sectional view of the developing device of FIG. 34 when it is vertically oriented.

Figure 1:
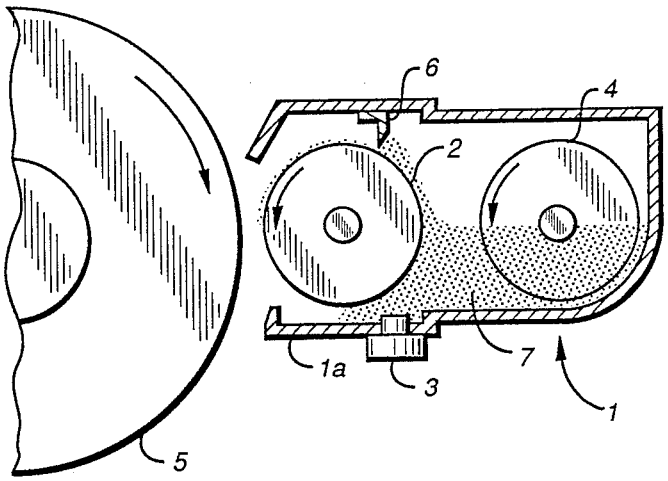
FIG. 1 (PRIOR ART)
FIG. 1 is a schematic frontal sectional view of a developing device of a prior art electrophotographic copier.

In all these figures, components which are substantially identical or at least similar to each other are indicated by the same alphanumeric symbols.

DETAILED DESCRIPTION OF THE INVENTION

In what follows, the present invention is described in detail by way of examples. One of the developing devices embodying the present invention is shown in FIGS. 3–6 and is characterized as having its developing tank comprised of a first developing section 10 which includes a developing roller 2 and a toner concentration sensor 3 and a second developing section 11 which includes a stirrer roller 4 and is removably attached to the first developing section. According to a preferable embodiment of the invention, the second developing section 11, as well as the stirrer roller 4 therein, is made of a synthetic resin material. On the side of the first developing section 10 opposite from the photoreceptor 5, there is formed a window **10*a* through which the developing agent 7 attached to the surface of the developing roller 2 can be transferred onto the photoreceptor 5. The other side of the first developing section 11 distal from the photoreceptor 5 is open. Similarly, the side of the second developing section 11 is open on the side of the photoreceptor 5 and the first and second developing sections 10 and 11 are attached to each other such that these open sides match each other. Means 12 for removably attaching the first and second developing sections 10 and 11 together include L-shaped engaging pieces 13 formed on the top (ceiling) plate 10***b* and the bottom (floor) plate 10*c* of the first developing section 10 adjacent to the opening end part thereof distal from the photoreceptor 5 and protrusions 14 from the top (ceiling) plate 11*b* and the bottom (floor) plate 11*c* of the second developing section 11 adjacent to its opening end on the side of the photoreceptor 5. These protrusions 14 are formed to engage with guiding grooves 13*a* formed by the L-shaped engaging pieces 13. Stoppers 15 are provided to the back end surface of the first developing section 10 for preventing the second developing section 11 from sliding off towards the back of the copier. Numerals 16 and 17 indicate side plates (in front and at back) respectively of the first and second developing sections 10 and 11. The side plates of the first developing section 10 are substantially of the same horizontal length as the first developing section 10 itself but the side plates 17 of the second developing section 11 are somewhat shorter than the second developing section 11 itself such that when the first and second developing sections 10 and 11 are attached to each other, their side plates 16 and 17 come into contact with each other across their contacting surfaces 16*a* and 17*a*.

Figure 3:
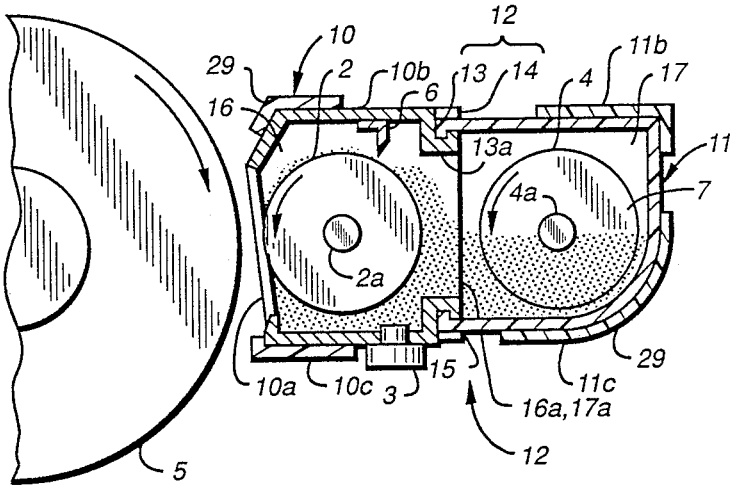
FIG. 3 is a frontal sectional view of a developing device embodying the present invention.
Figure 6:
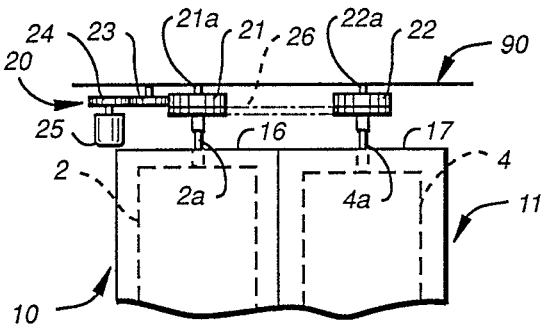
FIG. 6 is a plan view of a portion of the developing device of FIG. 3.

As shown in FIG. 6, the developing roller 2 and the stirrer roller 4 have their shafts 2*a* and 4*a* protruding through the side plates 16 and 17 of the first and second developing sections 10 and 11, respectively, and connected to driving means 20 for rotating them. The roller driving means 20 include sprockets 21 and 22 respectively for the developing roller 2 and the stirrer roller 4, a follower pinion 23 engaging with the sprocket 21 for the developing roller 2, a motor 25 having a driving pinion 24 engaging with this follower pinion 23 and a belt 26 stretched between the two sprockets 21 and 22. These sprockets 21 and 22 are supported by their respective axes 21*a* and 22*a* next to each other at a back section of the main body 90 of the copier. The axes of rotation 21*a* and 22*a* are hollow and there are splines formed on their inner surfaces for engaging with the shafts 2*a* and 4*a*. In FIG. 3, numeral 29 indicates a supporting member for not only supporting the developing tank but also guiding it when it is installed at its normal position. Other than the above, the developing device described above by way of FIGS. 3–6 is substantially identical to the prior art device shown in FIG. 1.

Let us assume that the developing agent 7 is of a one-component type. When the developing agent 7 has been consumed, the second developing section 11 is removed from the first developing section 10 and replaced by a new one. This is done first by pulling forward the entire developing tank 1 with both the first and second developing sections 10 and 11 together out of the main body 90 of the copier and then sliding the protrusions 14 of the second developing section 11 along the guiding grooves 13*a* in the direction away from the stoppers 15 (towards the front). If the second developing section 11 is made of a synthetic resin material, the coefficient of friction is smaller than if it is metallic and the second developing section 11 can be easily slid with respect to the first developing section 10. A new second developing section 11 is attached to the first developing section 10 by a reverse process. The protrusions 14 of the new second developing section 11 are engaged with the guiding grooves 13*a* from the side not having the stoppers 15 and the second developing section 11 is pushed such that its protrusions 14 are guided by the guiding grooves 13*a* and slide therealong until they are stopped by the stoppers 15 and the first developing section 10 and the new second developing section 11 form a single developing tank 1. Thereafter, the developing tank 1 thus formed is inserted into the copier main body 90. This is accomplished by engaging the shafts 2*a* and 4*a* protruding respectively from the side plates 16 and 17 on the back side with the axes 21*a* and 22*a* of the sprockets 21 and 22 such that the rollers 2 and 4 can rotate.

Figure 4:
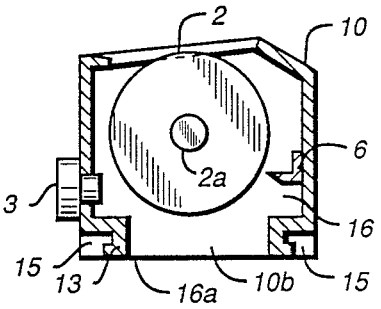
FIG. 4 is a frontal sectional view of the first developing section of the developing device of FIG. 3.
Figure 5:
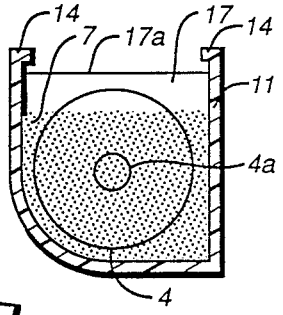
FIG. 5 is a frontal sectional view of the second developing section of the developing device of FIG. 3.

If the developing agent 7 is of a two-component type, the consumed developing agent 7 is first moved into the second developing section 11, for example, by tilting the developing tank 1. The second developing section 11 is thereafter removed from the first developing section 10 as shown in FIGS. 4 and 5 and a new second developing section 11 filled with developing agent 7 is attached to the first developing section 10 similarly as explained above.

In summary, the developing roller 2 and the toner concentration sensor 3, which are expensive, are saved because they are supported by the first developing section 10 and what is discarded for replacement is only the second developing section 11 which is made of an inexpensive synthetic resin material. In other words, replacement of the developing tank 1 can be achieved more economically with a developing device of the present invention. An additional advantage of forming the second developing section 11 with a synthetic resin material is that the developing tank 1 as a whole can be made lighter.

Figure 7:
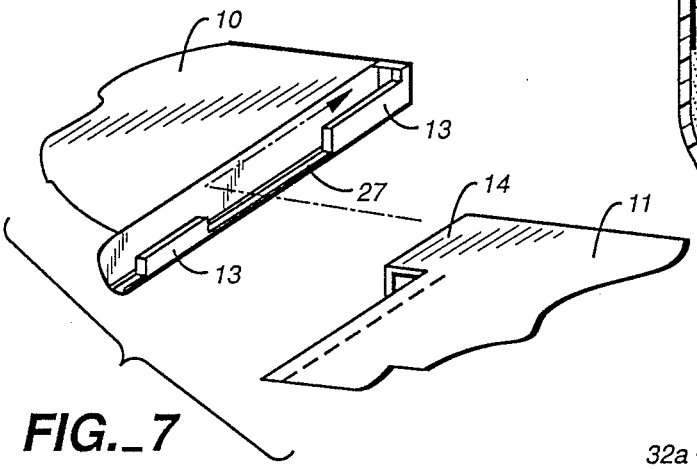
FIG. 7 is a diagonal view of a portion of another developing device embodying the present invention, FIG. 8 a frontal sectional view of a portion of still another developing device embodying the present invention to show its means for connecting its first and second developing sections, FIG. 9 a frontal sectional view of contact plates which are a portion of still another developing device embodying the present invention.

The means 12 for removably attaching the first and second developing sections 10 and 11 together are not limited by the description given above. The engaging pieces 13 may be formed on the second developing section 11 and the protrusions 14 on the first developing section 10, instead. Alternatively, as shown in FIG. 7, the L-shaped engaging pieces 13 may be made much shorter (say, 1 cm each) than the width (from front to back) of the first developing section 10 (on which they are formed). A plurality of such pieces 13, mutually separated, may be provided such that each interval 27 between two mutually adjacent ones of such pieces 13 serves to correctly position the matching one of the same number of protrusions 14 formed on the second developing section as the number of engaging pieces 13. The engaging pieces 13 and the protrusions 14 may be designed to have approximately the same length.

When the second developing section 11 is disengaged from the first developing section 10 if they are connected by means shown in FIG. 7, the protrusions 14 on the second developing section 11 have only to be slid along the guiding grooves 13*a* of the first developing section 10 by a short distance because each protruding piece 13 and protrusion 14 is only about 1 cm. After the protrusions 14 are slid along the grooves 13*a* and brought to the positions of the intervals 27, the second developing section 11 can be easily removed from the first developing section 10. When the second developing section 1 is attached to the first developing section 10, on the other hand, the protrusions 14 are passed through the intervals 27 between the engaging pieces 13 and slid along the guiding grooves 13*a*.

Figure 8:
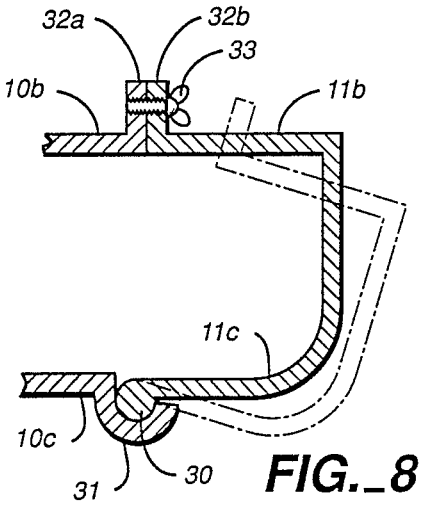

Still another mechanism for removably attaching the first and second developing sections 10 and 11 is shown in FIG. 8. A cylindrical member 30 with a substantially circular cross-sectional shape is formed as a part of the bottom plate 11*c* of the second developing section 11 and a receiving member 31 with a concave surface which rotatably supports the cylindrical member 30 is formed as a part of the bottom plate 10*c* of the first developing section 10. Contact plates 32*a* and 32*b* are formed respectively as parts of the top plates 10*b* and 11*b* of the first and second developing sections 10 and 11 such that they contact each other when the two developing sections 10 and 11 are attached together. Numeral 33 in FIG. 8 indicates a butterfly screw for securing the two contact plates 32*a* and 32*b* together.

In order t disengage the second developing section 11 from the first developing section 10 when they are engaged as shown in FIG. 8, the screw 33 is removed first and the second developing section 11 is rotated in the clockwise direction around the cylindrical member 30. Since the bottom plate 11*c* of the second developing section Il then presses the receiving member 31, the cylindrical member 30 can be easily separated from the receiving member 31. When the second developing section 11 is attached to the first developing section 10, the second developing section 11 is tilted as shown by dotted lines while care is taken not to spill the developing agent 7 a the cylindrical member 30 is engaged to the receiving member 31 and the second developing section 11 is rotated in the counter-clockwise direction. As the contact plates 32*a* and 32*b* come into contact with each other, they are fastened together by the screw 33. In short, attachment and removal can be effected easily by loosening or tightening the screw 33 and rotating the second developing section 11.

Figure 9:
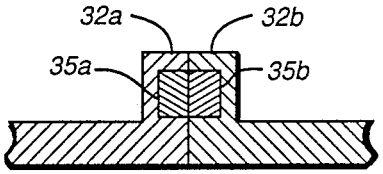
Figure 10:
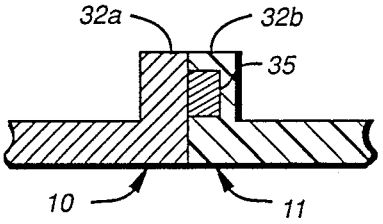
FIG. 10 is a frontal sectional view of contact plates which are a portion of still another developing device embodying the present invention, FIG. 11 a diagonal view of a portion of still another developing device embodying the present invention.

As a variation of the embodiment described above by way of FIG. 8, the contact plates 32*a* and 32*b* may be provided with bar magnets 35*a* and 35*b* affixed respectively thereonto and opposite to each other as shown in FIG. 9 such that the contact plates 32*a* and 32*b* can be kept closed by the attractive force between these magnets 35*a* and 35*b*. As a further variation, a single bar magnet 35 may be affixed to the contact plate 32*b* of the second developing section 11 as shown in FIG. 10 with the contact plate 32*a* of the first developing section 10 made of a metal such that the attractive force between the magnet 35 and the metal keeps the two developing sections 10 and 11 closed.

Figure 11:
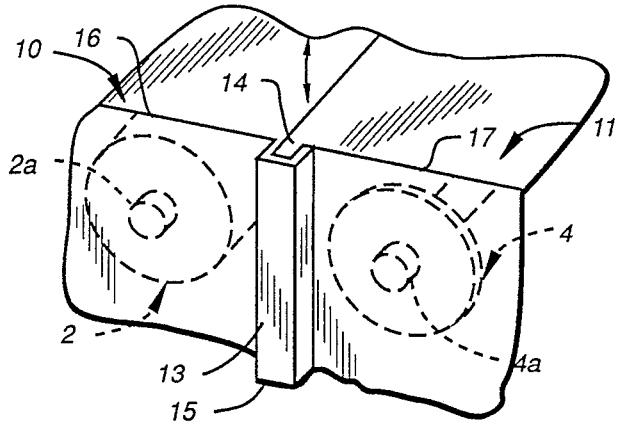

Still another mechanism for removably connecting the first and second developing sections 10 and 11 is shown in FIG. 11. This mechanism is different from those described above in that the second developing section 11 is moved vertically to be disengaged from the first developing section 10. Thus, vertical L-shaped engaging pieces are formed on the side plates 16 of the first developing section 10 and vertical protrusions (protruding horizontally) are formed on the side plates 17 of the second developing section 11 to engage with the vertical engaging pieces. On the bottom end surface of the engaging piece is a stopper 15 for preventing the second developing section 11 from sliding too far down with respect to the first developing section 10.

Figure 12:
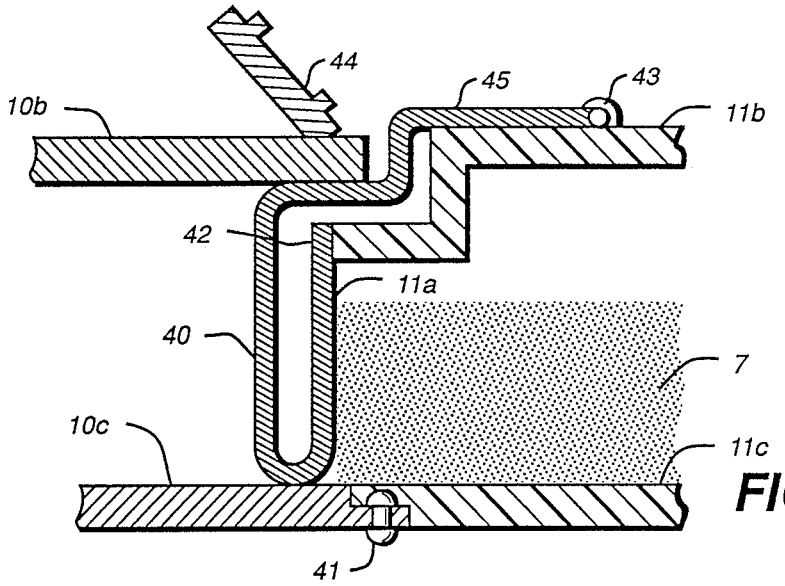
FIG. 12 is a frontal sectional view of a portion of still another developing device embodying the present invention.

FIG. 12 shows the connecting part of the first and second developing sections 10 and 11 of still another developing device embodying the present invention characterized as having a film-like curtain 40 attached to the opening 11*a* of the second developing section 11 so as to prevent the developing agent 7 from spilling from the tank 1 (or the second developing section 11) when the second developing section 11 is attached to the first developing section 10. As shown in FIG. 12, the floor plates 10*c* and 11*c* of the first and second developing sections 10 and 11 are fastened together by means of screws 41 and the second developing section 11 supports a take-up rod 43 by means of which the curtain 40 is removed from the opening end surface 42 of the second developing section 11 after the first and second developing sections 10 and 11 are securely joined together such that the developing agent 7 can move into the first developing section 10. Numeral 44 indicates a lid for closing the slit 45 which is formed between the ceiling plates 10*b* and 11*b* of the first and second developing sections 10 and 11 and through which the curtain 40 is wound up.

With a developing device thus formed, the screws 41 are removed when the second developing section 11 is to be removed and discarded. After a new second developing section 11 is attached, the take-up rod 43 is turned to remove the curtain 40 gradually from the opening end surface 42 of the opening 11*a*. After the curtain 40 is completely wound up, the lid 44 is closed to block the slit 45 through which the curtain 40 was removed. In this manner, the developing agent 7 is allowed to flow into the first developing section 10 only after the two developing sections 10 and 11 are securely joined together and can be prevented from spilling.

Figure 13:
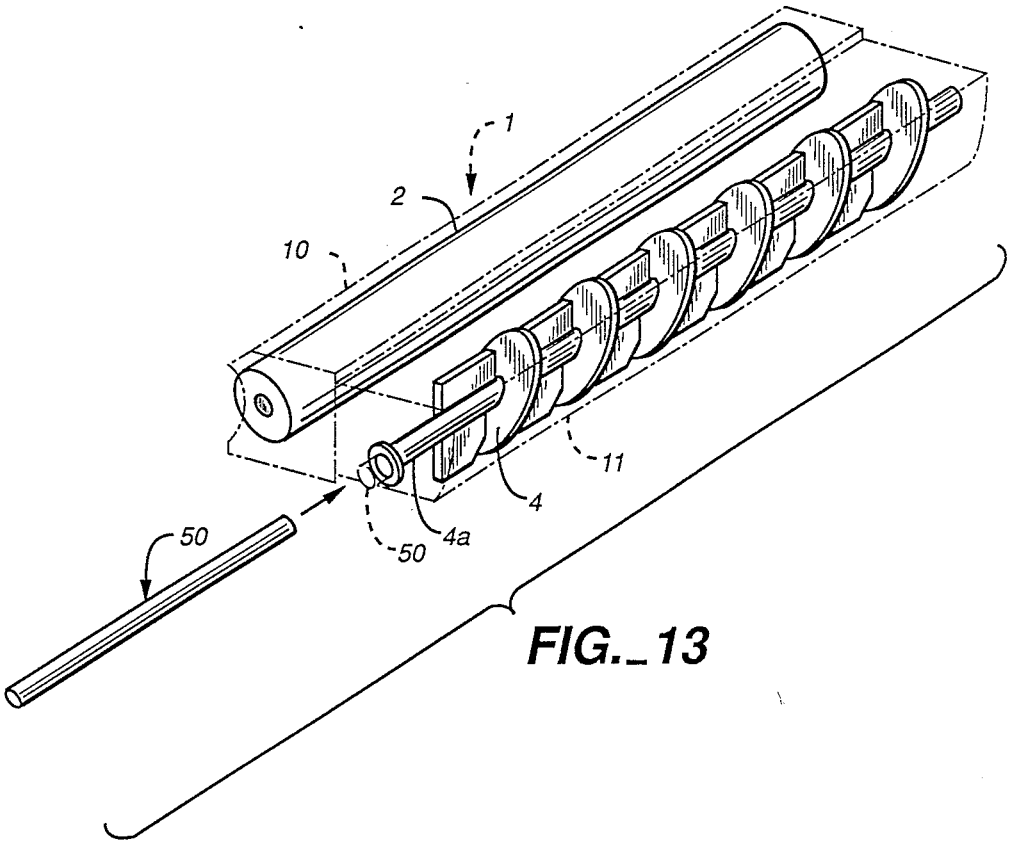
FIG. 13 is a diagonal view of a developing tank, partially broken to show its interior structure, of still another developing device embodying the present invention.
Figure 14:
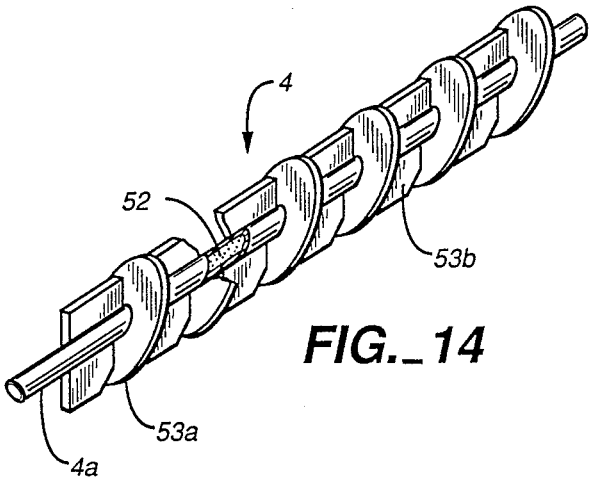
FIG. 14 is a diagonal view of the stirrer roller shown in FIG. 13.

FIGS. 13 and 14 show another developing device embodying the present invention characterized as having the shaft 4*a* of the stirring roller 4 formed with a cylindrical chamber 52 for containing therein a bar magnet 50 with a circular cross-sectional shape for effective collection of the developing agent 7. The bar magnet 50 is slightly longer than the length of the chamber 52 such that the user can grab its end part to pull it out of the chamber 52. In FIG. 14, numerals 53*a* and 53*b* indicate disk-shaped and rectangular vanes formed on the external periphery of the shaft 4*a* of the stirrer roller 4.

During a developing process, the bar magnet 50 is removed from the shaft 4*a* and kept in a storage section (not shown) appropriately provided inside the copier housing. When the developing agent 7 is consumed and the developing device is to be replaced by a new one, however, the developing agent 7 is still left both in the first and second developing sections 10 and 11. In order to remove such left over developing agent 7, the user holds the bar magnet 50 and inserts it into the chamber 52 formed inside the shaft 4*a* as shown in FIG. 13. The magnetic force of the bar magnet 50 causes the developing agent 7 left inside the developing tank 1 to be attracted to the stirrer roller 4 and to move into the second developing section 11. If the second developing section 11 is thereafter removed from the first developing section 10 as shown in FIGS. 4 and 5 with the opening side of the second developing section 11 facing upward, the developing agent 7 can be easily prevented from spilling out. The bar magnet 50 is pulled out of the chamber 52 and removed from the shaft 4*a* before the second developing section 11 is discarded. With such use of the bar magnet 50 according to the present invention, the developing agent 7 can be collected with improved efficiency.

Figure 15:
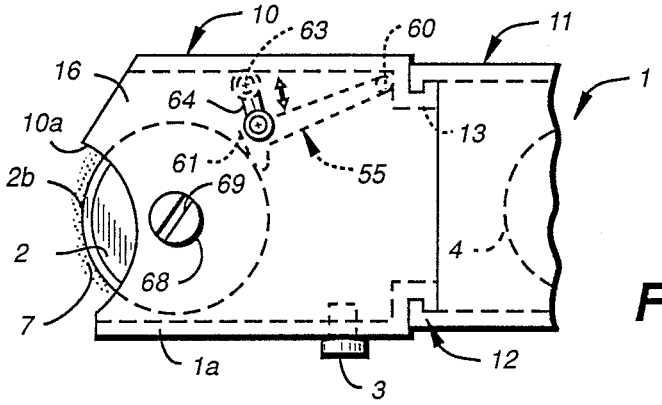
FIG. 15 is a frontal view of a portion of still another developing device of a copier embodying the present invention, showing its interior structure by dotted lines.

FIG. 15 shows a portion of still another developing device embodying the present invention characterized as having a scraper 55 which can selectively assume a scraping position adjacent to the surface (or a sleeve 2*b* to be described more in detail below) of the developing roller 2 and a released position distal therefrom. The scraper 55 is rotatably supported by the side plates 16 of the first developing section 10 around an axis 60 near the L-shaped engaging piece formed on the ceiling piece. The free-swinging end of the scraper 55 distal from the axis 60 has a protrusion 61 formed for scraping developing agent 7 off the sleeve 2*b*. Screw holes 62 are formed on the protrusion 61. The side plates 16 of the first developing section are correspondingly provided with elongated guiding holes 64 for guiding screws 63 which engage the screw holes 62 of the protrusion 61. Thus, with these screws 63 tightened, the scraper 55 can be fastened either at the scraping position or the released position.

Figure 16:
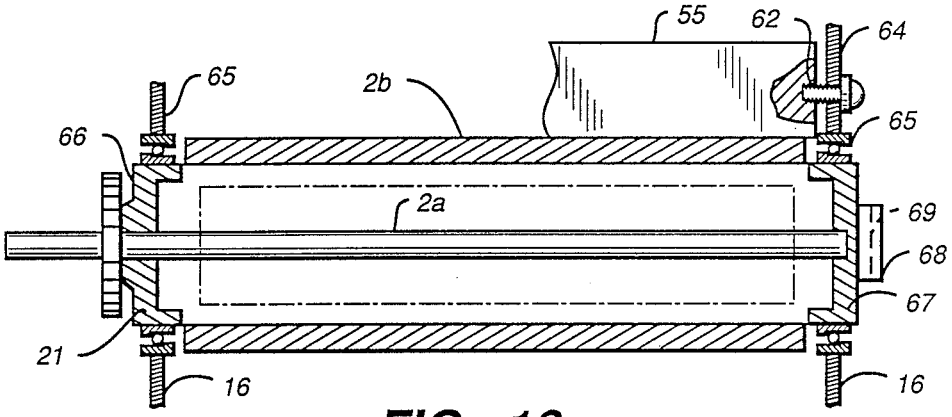
FIG. 16 is a sectional side view of a portion of the developing device shown in FIG. 15.

As shown in FIG. 16, the sleeve 2*b* of the developing roller 2 is supported by the side plates 16 of the first developing section 10 through bearings 65. Numerals 66 and 67 indicate lids for covering the side surfaces of the developing roller 2. Numeral 68 indicates a plate fastened to the lid 67 for rotating the sleeve 2*b*. A groove 69 is formed on this plate 68 as shown in FIG. 15 such that the sleeve 2*b* can be rotated by inserting the tip of a screw driver or the like into the groove 69. The shaft 2*a* of the developing roller 2 is affixed to and supported by the copier main body 90. The shaft 4*a* of the stirrer roller 4 contains a bar magnet 50 as shown in and explained in connection with FIG. 13.

During a developing process, the scraper 55 is set in the release position away from the sleeve 2*b*. When the developing agent 7 has been spent and the second developing section 11 is about to be disengaged from the first developing section 10 to be replaced by a new one, the developing agent 7 is on the sleeve 2*b* of the developing roller 2 because of the magnetic force of its magnets. In order to remove the developing agent 7 from the sleeve 2*b*, the screw 63 is loosened and the scraper 55 is turned around the axis 60 with the screw 63 still attached to the scraper 55 such that the screw 63 slides through the elongated guiding hole 64. The protrusion 61 is then brought to the scraping position, say, 1 mm from the sleeve 2*b* and the screw 63 is tightened. Thereafter, the developing tank 1 is pulled slightly forward such that the shafts 2*a* and 4*a* of the developing roller 2 and stirrer roller 4 become disengaged from the splines of the sprocket axes 21*a* and 22*a*, thereby preventing the sleeve 2*b* and stirrer roller 4 from rotating together.

If the tip of a screwdriver or the like is inserted into the groove 69 on the plate 68 and the sleeve 2*b* is caused to rotate as explained above, the protrusion 61 of the scraper 55 scrapes off the developing 7 attached to the sleeve 2*b*, the scraped developing agent falling in the direction of the second developing section 11. Thereafter, the bar magnet 50 is inserted into the chamber 52 inside the shaft 4*a* as explained above such that nearly all the developing agent 7 moves into the second developing section 11 and the second developing section can be effectively removed from the first developing section 10 without spilling any developing agent 7.

Figure 17:
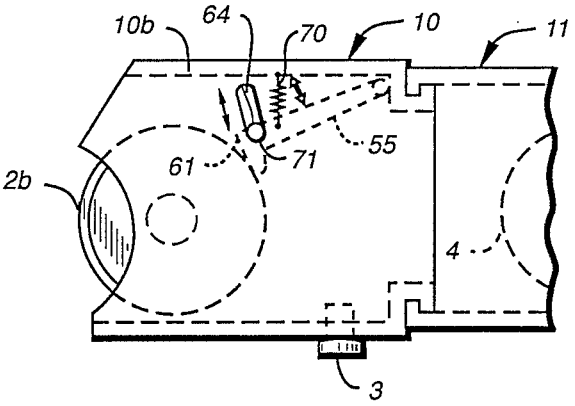
FIG. 17 is a frontal view of a portion of still another developing device embodying the present invention, showing its interior structure by dotted lines.

FIG. 17 shows another mechanism by which the scraper 55 may be controlled. The embodiment of the present invention according to FIG. 17 is characterized by a spring 70 for applying a biasing force on the scraper 55 to keep it normally in the release position away from the sleeve 2*b*. The spring 70 is stretched between the ceiling plate 10*b* of the first developing section 10 and approximately the center of the scraper 55. Numeral 71 indicates a small piece protruding from the scraper 55 near the protrusion 61 adapted to engage in the elongated guiding hole 64 described above. When it is desired to remove the second developing section 11 from the first developing section 10 and to remove the developing agent 7 from the sleeve 2*b* of the developing roller 2, the user pushes down the piece 71 against the biasing force of the spring 70 until the scraper 55 comes to the scraping position. Thereafter, as explained above by way of FIG. 15, a screwdriver or the like is used to rotate the sleeve 2*b*.

Figure 18:
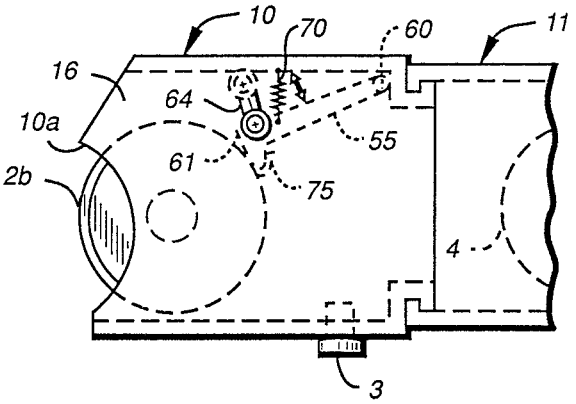
FIG. 18 is a frontal view of a portion of still another developing device embodying the present invention, showing its interior structure by dotted lines.
Figure 19:
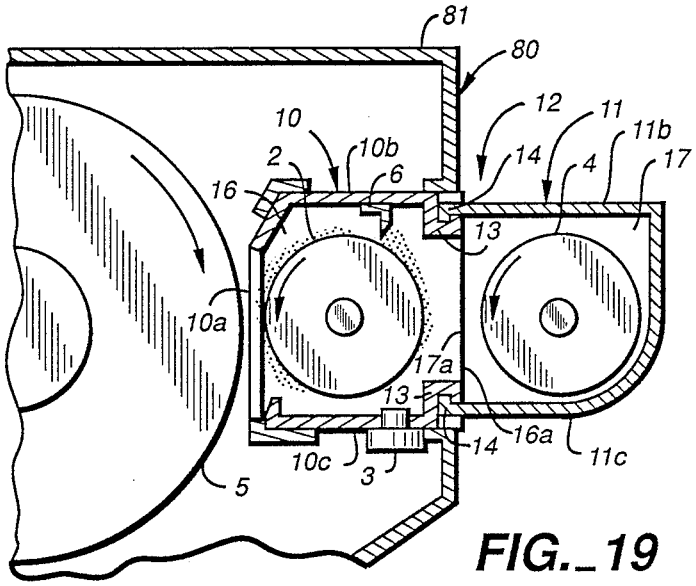
FIG. 19 is a frontal sectional view of still another developing device embodying the present invention.

FIG. 18 shows still another embodiment of the scraper 55 for removing the developing agent 7 attached to the sleeve 2*b*. This embodiment is characterized by the protrusion 61 from the scraper 55 covered by a protective member 75 made, for example, of sponge. When the scraper 55 is brought to the scraping position and the sleeve 2*b* is rotated as explained above by way of FIGS. 15 and 17, the protective member 75 is so adjusted as to touch the surface of the sleeve 2*b* such that not only is the surface of the sleeve 2*b* protected against the scraper 55 but also the developing agent 7 attached thereon can be nearly completely scraped off.

Figure 2:
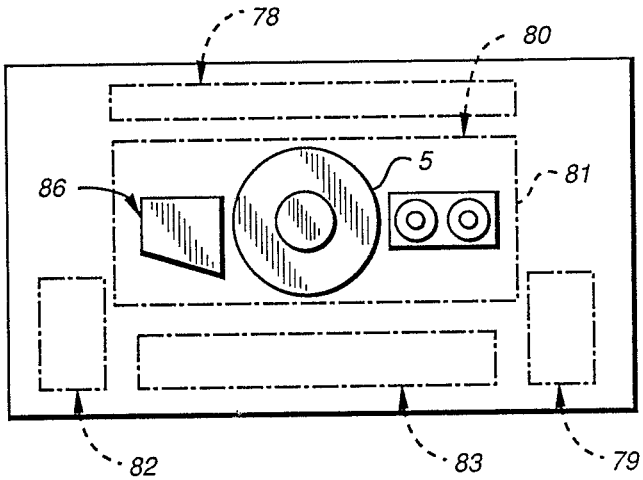
FIG. 2 (PRIOR ART)
FIG. 2 is a schematic frontal sectional view of a prior art copier with a photoreceptor, a developing device and a cleaning device contained within a case.
Figure 20:
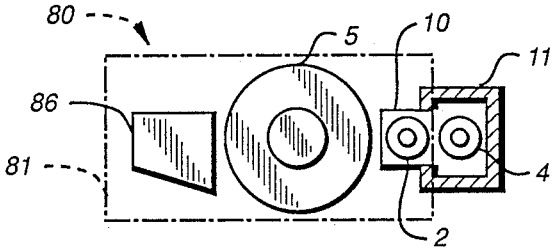
FIG. 20 is a schematic frontal sectional view of a copier incorporating the developing device shown in FIG. 19.
Figure 21:
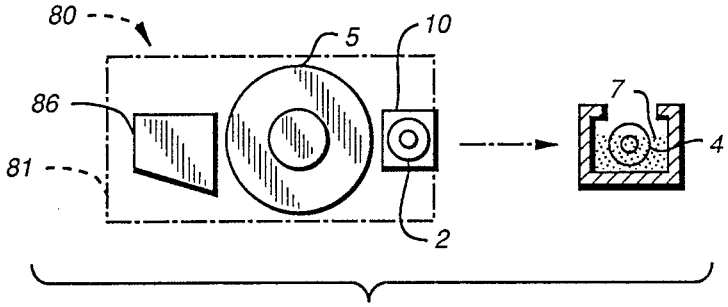
FIG. 21 is a schematic frontal sectional view of a copier incorporating the developing device shown in FIG. 19 when its second developing section has been removed from its first developing section.
Figure 22:
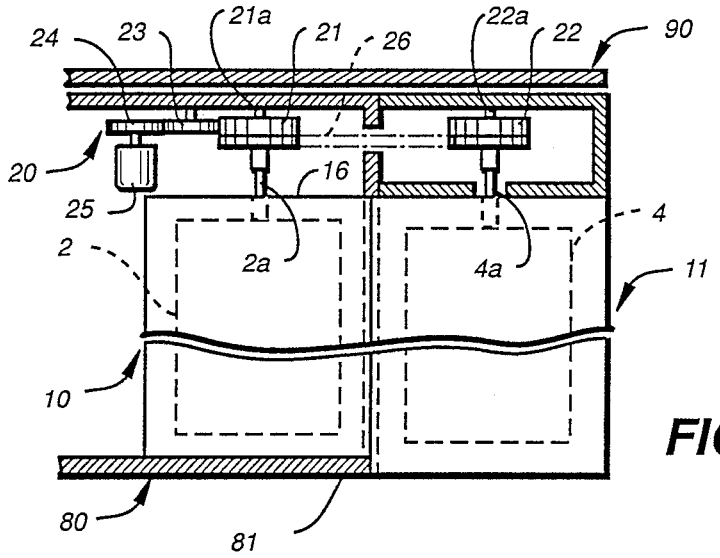
FIG. 22 is a plan sectional view of the developing device shown in FIG. 19, FIGS. 23 and 24 are frontal sectional views of a clam shell type copier incorporating still another developing device embodying the present invention when it is opened and closed, respectively.

The present invention has been described above by way of various developing devices adapted to be engageably attached to the copier main body 90. It is not intended, however, that this be interpreted as limiting the scope of the present invention. As explained above in connection with FIG. 2, some copiers include a detachable case containing not only a developing device but also the photoreceptor 5 and other devices. FIGS. 19–22 show a developing device embodying the present invention for a copier of this type characterized as not only having its developing device comprised of mutually disengageable first and second developing sections 10 and 11 as explained above but also having the case 81 of the developing unit 80 attached only to the first developing section 10 and having the developing tank either entirely or partially protruding outwardly from the case 81. The second developing section 11 protrudes out of the case 81 as shown in FIG. 20 and when the developing agent is spent, the second developing section 11 is removed from the first developing section 10 attached to the case 81 as shown in FIG. 21. In FIG. 22, numeral 84 indicates a protective case for the sprocket 22 for the stirring roller 4.

Figure 23:
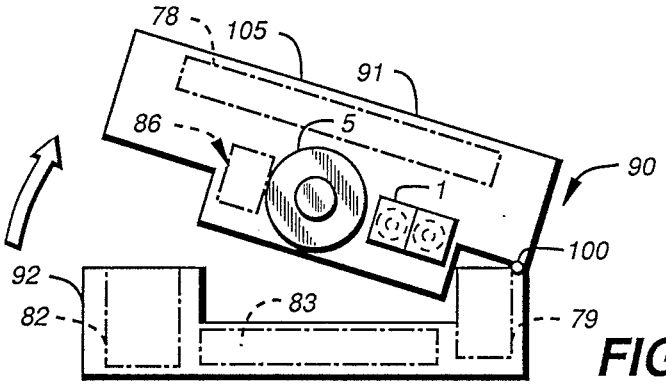
Figure 24:
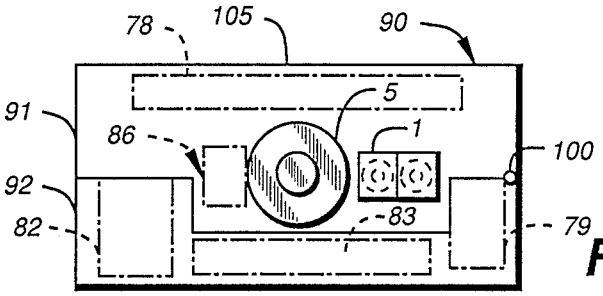

Next, a developing device embodying the present invention particularly adapted for use in a clam shell type copier is described by way of FIGS. 23–25. In FIGS. 23 and 24 which generally describe the structure of a clam shell type copier 90 when its openable part 91 is opened and closed with respect to its base part, respectively, numeral 100 indicates a horizontal axis through which the two parts 91 and 92 of its main body 90 are rotatably joined. Numerals 78, 79, 80, 82, 83 and 86 are as explained above in connection with FIG. 2.

Figure 26:
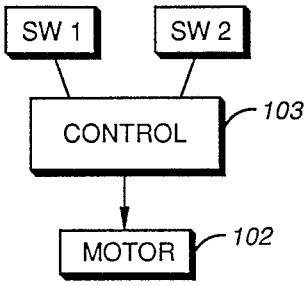
FIG. 26 is a block diagram of a control system for the developing device of FIG. 25.

In FIG. 25, numeral 110 generally indicates means for causing the developing tank 1 to vibrate when the openable part 91 is opened with respect to the base part 92. The vibrating means 110 according to one embodiment of the present invention include a piece 10*d* attached protrudingly downward from the bottom plate 10*c* of the first developing section 10, a cam 101 which rotates to come in contact with this protruding piece 10*d*, a motor for driving the cam 101 and a motor control 103 for controlling the driving of this motor as shown in FIGS. 25 and 26. In FIG. 26, SW1 indicates a switch for transmitting a signal to the control unit 103 if the openable part 91 has been opened for the purpose of replacing the second developing section. This switch SW1 may be disposed on a control panel shown in FIG. 24 at 105. In FIG. 26, SW2 indicates another switch for transmitting a signal if the openable part is open. The control unit 103 is connected to both switches SW1 and SW2 and is adapted to transmit a driving signal to a driving unit (not shown) for the motor 102 for a specified length of time.

Figure 27:
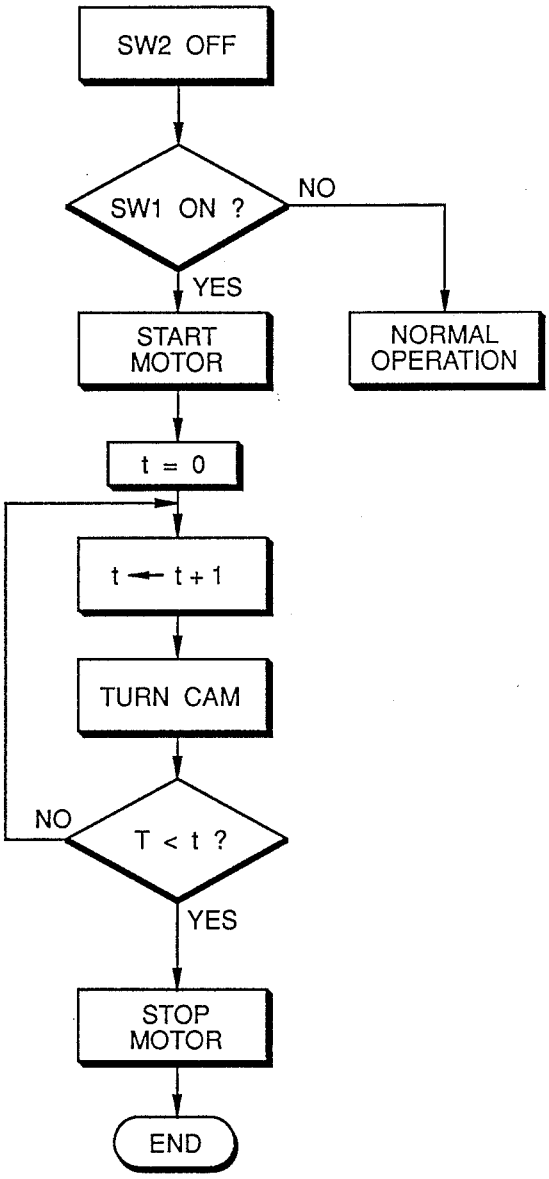
FIG. 27 is a control flow chart of the developing device of FIG. 25.

With the developing device thus structured, the control unit 103 automatically stops the operation of the copier when it is detected (by the switch SW2) that the openable part 91 has been rotated around the axis 100 to be opened from the base part 92. As shown in the flow chart of FIG. 27, however, if the openable part 91 is closed (as detected by the detection switch SW2) and if the switch SW1 for detecting the replacement of developing device is in the ON condition, indicating that the openable part 91 has been opened for the purpose of replacing the developing device, the control unit 103 transmits a drive signal to the motor 102 for a predetermined length of time (from initial time t=0 to t=T in FIG. 27). When the motor 102 is activated and the cam 101 is caused to rotate, pieces 101*a* radially protruding from the cam 101 intermittently and repeatedly hit the attached piece 10*d* on the bottom plate 10*c* of the first developing section 10. Furthermore, since the openable part 91 is tilted at this time as shown in FIG. 23 such that the first developing section 10 is positioned somewhat higher than the second developing section 11, the tapping on the attached piece 10*d* by the cam 101 causes the entire bottom plate 10*c* of the first developing section 10 to vibrate and hence the developing agent 7 to move into the second developing section 11. Thereafter, the developing tank 1 is removed from the main body 90 and the second developing section 11 is disengaged from the first developing section as explained above. Since the developing agent 7 is already mostly within the second developing section 11, the developing agent 7 is thereby efficiently collected.

Figure 28:
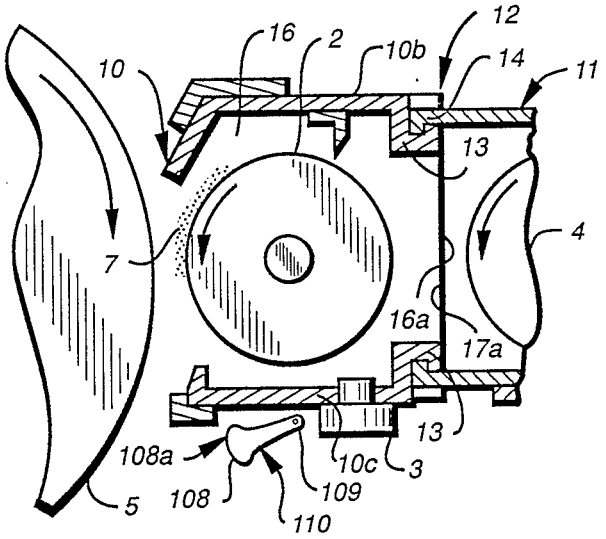
FIG. 28 is a frontal sectional view of a portion of still another developing device embodying the present invention, showing its floor tapping mechanism.

FIG. 28 shows another developing device provided with a manually operated vibrating means 110 comprised of an elastic tapping member 108 which is fastened to a shaft 109 and has an enlarged end section 108*a*. When the second developing section 11 is ready to be replaced, the openable part 91 is opened to the position as shown in FIG. 23 and the user holds the enlarged end section 108*a* of the elastic tapping member 108 downward, pulls it down around the shaft 109 against the elastic restoring force of the member 108 and releases it. This causes the elastic member 108 to spring back to the original position by its own restorative force and taps the bottom plate 10*c* of the first developing section 10. If this is repeated several times, the impact and the resultant vibration of the bottom plate 10*c* causes the developing agent 7 to move into the second developing section 11.

Figure 29:
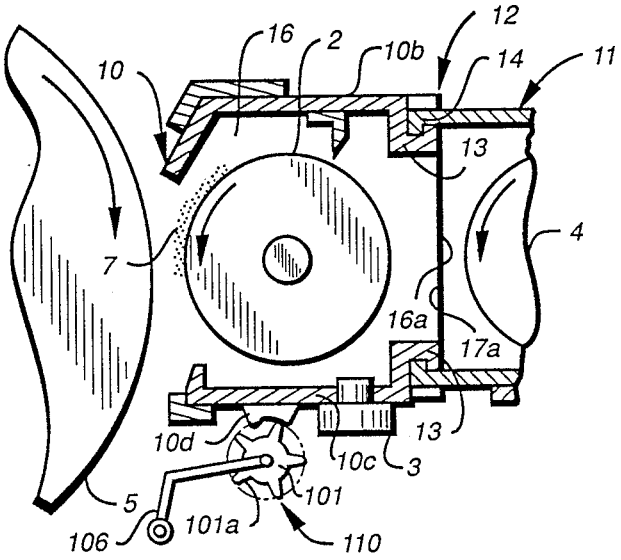
FIG. 29 is a frontal sectional view of a portion of still another developing device embodying the present invention, showing its floor tapping mechanism.

FIG. 29 shows still another means for causing the bottom plate 10*c* of the first developing section 10 to vibrate for the same purpose. The vibrating means 110 according to this embodiment comprises a cam 101 and a handle 106 which is attachable to the axis of the cam 101. When the cam is manually rotated by the handle 106, its protruding pieces 101*a* hit the piece 10*d* attached to the bottom plate 10*c* of the first developing section 10 as explained above by way of FIG. 25.

Figure 30:
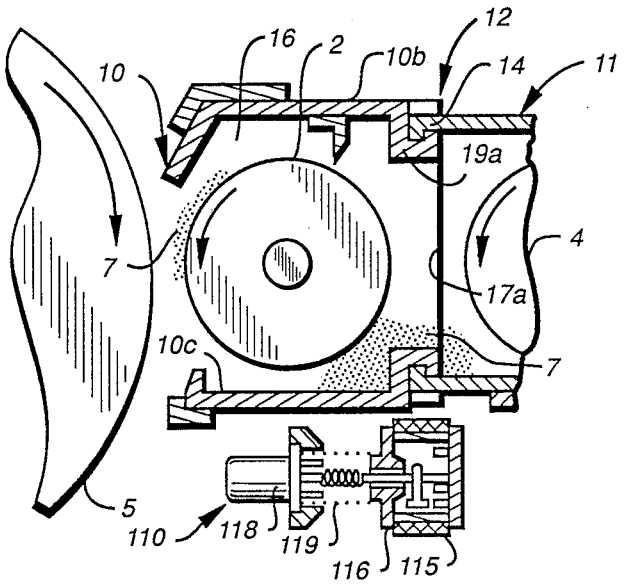
FIG. 30 is a frontal sectional view of a portion of still another developing device embodying the present invention.

FIG. 30 shows still another vibrating means 110 for causing the bottom plate 10*c* of the first developing section 10 to vibrate. This vibrating means 110 is comprised of a tapping member 115 for tapping the bottom plate 10*c* of the first developing section 10 from below, a weight 117 which is engaged around an axis 116 and serves to cause minute vibrations of the tapping member 115, a motor 118 for rotating the axis 116, and a connector spring 119 for connecting the shaft of the motor 118 and the axis 116. When the second developing section 11 is to be removed from the first developing section 10, the control unit 103 for this vibrating means 110 similarly transmits a drive signal for a specified length of time T to cause the motor 118 to rotate.

Figure 31:
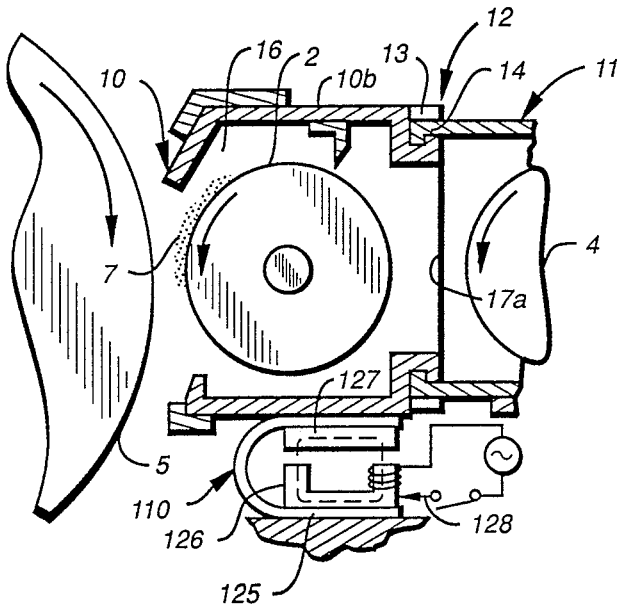
FIG. 31 is a frontal sectional view of a portion of still another developing device embodying the present invention.

According to still another embodiment of the present invention shown in FIG. 31, the vibrating means 110 is comprised of a U-shaped vibrating spring 125, a fixed iron core and a movable iron core 127 attached to this spring 125, and a circuit 128 for generating a magnetic flux through these iron cores 126 and 127. When the second developing section 11 is to be removed from the first developing section 10, the control unit 103 causes the circuit 128 to be closed for a predefined length of time T. A magnet flux is thereby generated within the iron cores 126 and 127 and the spring 125 is caused to vibrate, say, 60 times per second.

Figure 32:
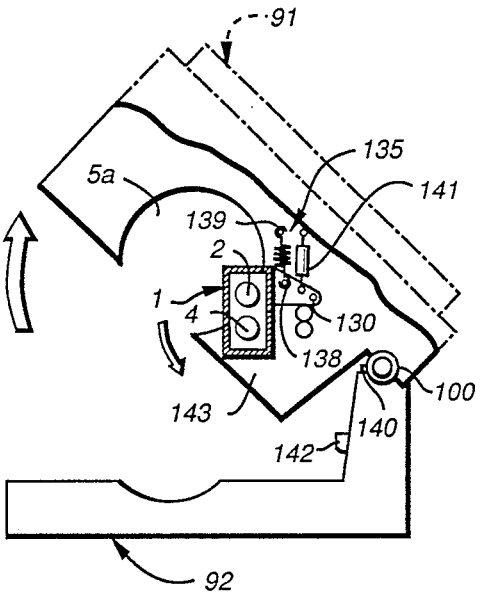
FIGS. 32 and 33 are frontal sectional views of still another clam shell type copier incorporating still another developing device embodying the present invention when it is opened and closed and the developing device is vertically and horizontally oriented, respectively.
Figure 33:
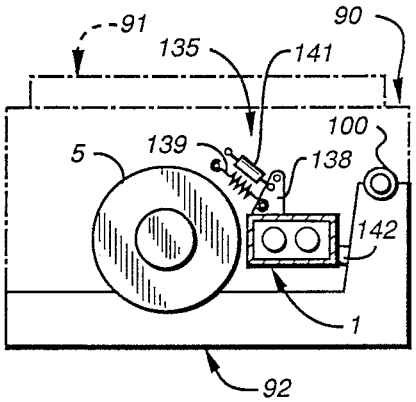

FIGS. 32 and 33 show another clam shell type copier embodying the present invention characterized as having its developing device rotatably supported by the openable part 91 of the separable main body 90 around a horizontal axis of rotation 130 and a rotating means 135 (to be explained in detail below) for causing the developing device to rotate around this axis of rotation 130 such that the second developing section 11 is directly below the first developing section 10 when the openable part 91 is opened as shown in FIG. 32. Although not shown in FIGS. 32 and 33, it is understood that the developing device is disposed between the photoreceptor 5 and the axis 100 between the openable and base parts 91 and 92 as shown in FIGS. 23 and 24 and that the photoreceptor 5 and the developing device are both supported by the openable part 91 of the main body 90.

Figure 34:
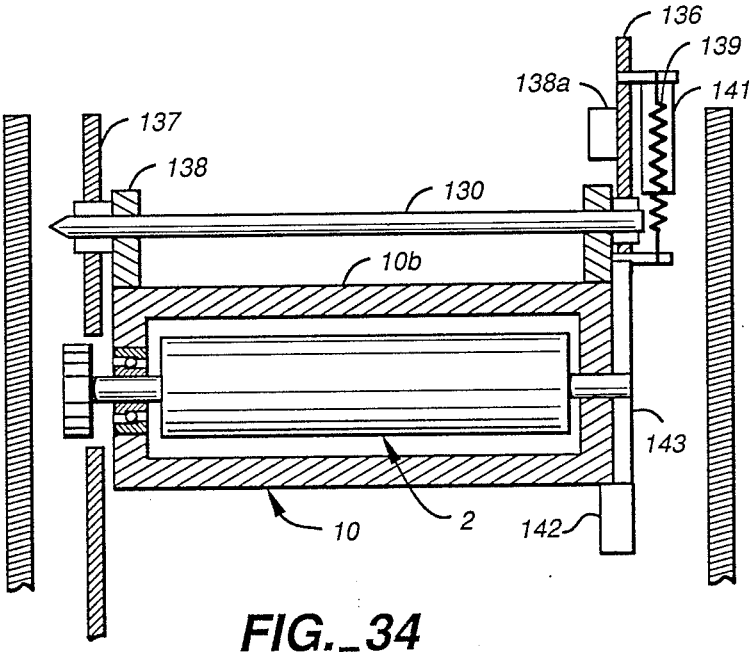
FIG. 34 is a sectional side view of the developing device shown in FIGS. 32 and 33.

As shown in FIG. 34, the developing device is disposed between front and back supporting plates 136 and 137 and is fastened through triangular brackets 138 to the aforementioned axis of rotation 130 which penetrates these supporting plates 136 and 137 and attached thereto through bearings. The aforementioned brackets 138 are formed at the forward and backward ends on the ceiling plate 10*c* of the first developing section 10.

The rotating means 135, according to the embodiment shown in FIG. 33, is comprised of a tensile spring 139 for applying a biasing force which tends to rotate the developing device in the clockwise direction (with respect to FIG. 24) around the axis of rotation 130 and a solenoid 141 which serves to rotate the developing device in the counter-clockwise direction by means of a switch 140 activating when the openable part 91 begins to close. One end of the spring 139 is attached by a pin to the openable part 91, the other end thereof being attached by another pin to one of the brackets 138 as shown in FIGS. 33 and 34. The solenoid 141 is also connected by a pin to the frontal supporting plate 136 of the openable part 91 and its plunger is connected to the bracket 138 of the developing tank 1 also by a pin. In FIG. 34, numeral 138*a* indicates a stopper formed on the supporting plate 136 for maintaining the developing tank 1 in the rotated and nearly vertical position. In FIGS. 32 and 33, numeral 142 indicates a supporting member formed on the base part 92 for maintaining the developing device in a horizontal position. In FIGS. 32 and 34, numeral 143 indicates cut-out portions of the frontal and backward supporting plates 136 and 137 for allowing the developing device to freely rotate.

Figure 36:
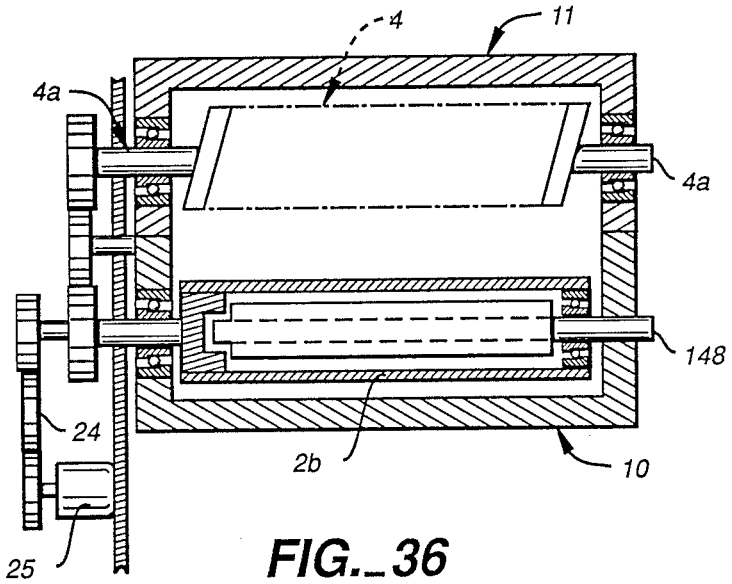
FIG. 36 is a sectional plan view of the developing device shown in FIGS. 34 and 35, and FIGS. 37 and 38 are frontal sectional views of still another clam shell type copier incorporating still another developing device embodying the present invention when it is opened and closed and its developing device is vertically and horizontally oriented, respectively.

The developing roller 2 is comprised, as shown in FIGS. 35 and 36, of a central body 147 having ferite magnets 145 with 3–5 poles, a supporting axis 148 for the central body 147, the sleeve 2*b* which externally engage with the central body 147 and another axis 149 for supporting the sleeve 2*b*. As shown in FIG. 36, the front end of the axis 148 of the central body 148 is affixed to the frontal side plate 16 of the first developing section 10. The axis 149 for supporting the sleeve 2*b* is supported by the back side plate 16 of the first developing section 10 through bearings. The stirrer roller 4 is formed with disk-like vanes 53*a* as shown in FIG. 14. The backward ends of the axes 149 and 4*a* respectively of the sleeve 2*b* and the stirrer roller 4 penetrate the aforementioned cut-out portion 143 of the plate 17.

As shown in FIG. 33, the developing tank 1 assumes a horizontal position when the openable part 91 of the main body 90 is closed. Although a biasing force in the clockwise direction is applied thereonto by the spring 139, the second developing section 11 is in contact with the supporting member 142 by means of the solenoid 141. The developing tank 1 maintains this horizontal position during a development process. When the developing agent 7 is spent and it is desired to exchange the developing tank 1, the photoreceptor 5 is removed from its normal position shown in FIG. 32 at 5*a*. Thereafter, the openable part 91 of the main body 90 is lifted, rotating in the clockwise direction around the axis 100, to the position shown in FIG. 32. This causes the developing tank 1 to move with the openable part 91 and since the solenoid switch 140 is thereby brought to the OFF condition, the solenoid 141 becomes released and the developing tank 1 is rotated in the clockwise direction around the axis of rotation 130 by the biasing force of the spring 139 which is now unopposed. The developing tank 1 rotates until it hits the stopper 138*a* and assumes a vertical position as shown in FIG. 32. Since the photoreceptor 5 is already removed as explained above, the developing tank 1 is free to rotate.

When the developing tank 1 thus assumes a vertical position, the second developing section 11 is directly underneath the first developing section 10. Thus, the portion of the developing agent 7 not attached to the developing roller 2 falls straight into the second developing section 11. A part of the developing agent 7 on the developing roller 2 also falls into the second developing section 11 because a part of the developing roller 2 not having any of the magnets 145 (the so-called agent releasing pole) exerts no magnetic force. The magnetically attracted part of the developing agent can be dropped off if the sleeve 2*b* is rotated such that the doctor blade 6 can scrape the deposited developing agent 7. The sleeve 2*b* may be rotated manually or by communicating a motive force from the main body 90 of the copier for a predetermined length of time. Alternatively, its motion maybe controlled by detecting the release of developing agent 7 from the developing roller 2 through an output from the toner concentration sensor 3.

After a new second developing section 11 is installed, the openable part 91 of the main body 90 is pushed down. This causes the solenoid switch 140 to be pressed and the developing tank 1 is rotated in the counter-clockwise direction around the axis 130 by the activated solenoid 141 until the developing tank 1 again assumes the normal horizontal position shown in FIG. 33. Thereafter, the photoreceptor 5 is put back in its normal position 5*a*.

Figure 37:
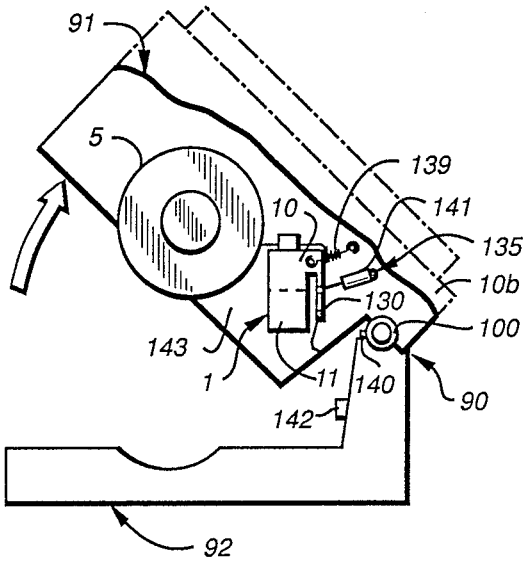
Figure 38:
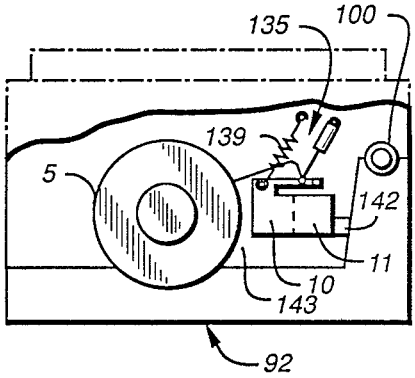

FIGS. 37 and 38 show another clam shell type copier embodying the present invention which is similar to the one described above by way of FIGS. 32, 33, etc. and is characterized as having the axis of rotation 130 for the developing tank 1 so positioned that the second developing section 11 can be replaced without first removing the photoreceptor 5. Brackets 138 according to this embodiment of the present invention is extended from the ceiling plate 10*b* of the first developing section 10 to a position above the ceiling plate 11*b* of the second developing section 11 and the axis of rotation 130 is located at the far ends of these brackets 138. In short, since the axis of rotation 130 is farther removed from the photoreceptor 5 than in the case of the developing tank shown in FIGS. 32 and 33, the developing tank 1 can rotate around the axis 130 without hitting the photoreceptor 5 and hence it is not necessary to remove the photoreceptor 5 as a part of the process of exchanging the second developing section 11.

Many embodiments of the present invention have been described above but they are not intended to be exhaustive or to limit the scope of the invention. Many modifications and variations are possible in light of the above teaching. For example, the solenoid 141 in FIGS. 32, 33, 37 and 38 is not a required component. Use may be made only of the spring 139, if the user remembers to rotate the developing tank 1 in the counter-clockwise direction when the openable part 91 of the main body 90 is closed. Any modifications and variations that may be apparent to a person skilled in the art are intended to be included within the scope of this invention.

What is claimed is:

1. In a developing device of an electrophotographic copier, said developing device comprising a developing tank, a developing roller normally disposed adjacent to a photoreceptor and a stirrer roller for stirring developing agent inside said developing tank, the improvement wherein said developing device includes a first section which contains said developing roller and a second section which contains said stirrer roller, said first and second sections being detachably attached to each other, said stirring roller having a hollow shaft with a chamber formed therethrough and said developing device further comprising a bar magnet which is insertable into said chamber.

2. The developing device of claim 1 wherein said second section is made of a less expensive material than said first section.

3. The developing device of claim 1 wherein said second section is made of a synthetic resin material.

4. The developing device of claim 1 wherein said first section includes an L-shaped guiding piece forming a guiding groove and said second section includes a protruding piece which is engageable with said guiding piece and slidable along said guiding groove, thereby engaging and disengaging said second section with respect to said first section.

5. The developing device of claim 1 wherein said first section includes a receiving member with a concave surface and a first contact plate and said second section includes a cylindrical edge in contact with said concave surface and a second contact plate removably attached to said first contact plate.

6. The developing device of claim 1 wherein said second section includes a curtain which serves at initial position thereof to block the motion of developing agent from said second section into said first section and means for removing said curtain from said initial position.

7. The developing device of claim 1 wherein said first section includes a scraper for removing developing agent attached to said developing roller and means for selectively positioning said scraper at a first position adjacent to said developing roller for scraping and a second position farther removed from said developing roller.

8. The developing device of claim further comprising a case which envelopes said photoreceptor therein, said case being secured to said first section and said developing tank protruding at least partially out of said case.

9. The developing device of claim 1 wherein said copier comprises a main body separable into a base part and a top part which is rotatably connected to said base part around a shaft such that said top part can be opened and closed with respect to said base part, said developing device being supported by said top part.

10. The developing device of claim 9 further comprising means for causing said developing tank to vibrate when said top part is opened.

11. The developing device of claim 9 further comprising an axis which serves to rotatably connect said developing tank to said top part of said main body and rotating means for causing said developing tank to rotate around said axis until said second section comes to a position directly under said first section when said top part is opened.

12. The developing device of claim 11 wherein said axis is disposed sufficiently far from said photoreceptor such that said developing tank does not hit said photoreceptor by rotating around said axis.

13. The developing device of claim 11 wherein said rotating means include a spring-like biasing means for applying a biasing force on said developing tank around said axis.

14. The developing device of claim 13 wherein said rotating means further include a solenoid which is activated and deactivated by opening and closing said top part of said main body.

* * * * *